US007325940B2

(12) United States Patent
Cea et al.

(10) Patent No.: US 7,325,940 B2
(45) Date of Patent: Feb. 5, 2008

(54) ILLUMINATED JEWELRY CASE

(76) Inventors: Todd A. Cea, 1705 Bancroft St., Cuyahoga Falls, OH (US) 44221; Russell A. Urban, 10606 Lagrange Rd., Elyria, OH (US) 44035; Ron Kovac, 1337 Commerce Dr., Unit #5, Stow, OH (US) 44224

( * ) Notice: Subject to any disclaimer, the term of this patent is extended or adjusted under 35 U.S.C. 154(b) by 0 days.

(21) Appl. No.: 11/542,843

(22) Filed: Oct. 4, 2006

(65) Prior Publication Data

US 2007/0115653 A1 May 24, 2007

Related U.S. Application Data

(60) Provisional application No. 60/738,127, filed on Nov. 18, 2005.

(51) Int. Cl.
*F21V 33/00* (2006.01)

(52) U.S. Cl. ..... 362/155; 362/104; 362/156; 206/6.1; 206/566

(58) Field of Classification Search ..... 362/104, 362/154–156, 802; 206/6.1, 566
See application file for complete search history.

(56) References Cited

U.S. PATENT DOCUMENTS

| | | | | |
|---|---|---|---|---|
| 712,112 | A | 10/1902 | Arnold | |
| 3,937,320 | A | 2/1976 | Chao et al. | |
| 5,329,433 | A | 7/1994 | Geeting et al. | |
| 6,405,858 | B1 | 6/2002 | Gagliardi | |
| 6,844,686 | B1 | 1/2005 | Schneck et al. | |
| 2005/0152133 | A1* | 7/2005 | Kao et al. | 362/155 |

* cited by examiner

*Primary Examiner*—Stephen F Husar
(74) *Attorney, Agent, or Firm*—Sand & Sebolt

(57) ABSTRACT

An illuminated jewelry case comprising a base having a jewelry mounting location adapted for removably mounting a piece of jewelry; a lid pivotally connected to the base and movable between open and closed positions; at least one LED disposed on the lid for illuminating the jewelry mounting location when the lid is in the open position; and a ribbon cable in electrical communication with the at least one LED and a pair of battery contacts disposed on the base.

27 Claims, 3 Drawing Sheets

ILLUMINATED JEWELRY CASE

CROSS REFERENCE TO RELATED APPLICATIONS

This application claims priority from U.S. Provisional Application Ser. No. 60/738,127, filed Nov. 18, 2005; the disclosure of which is incorporated herein by reference.

BACKGROUND OF THE INVENTION

1. Technical Field

The invention relates generally to jewelry cases. More particularly, the invention relates to illuminated jewelry cases. Specifically, the invention relates to jewelry cases which are illuminated by LEDs.

2. Background Information

Illuminated jewelry cases are known in the art. However, there is still room for improvement with regard to both the configuration and operation of such jewelry cases. The present invention provides such improvements.

BRIEF SUMMARY OF THE INVENTION

The present invention provides an illuminated jewelry case comprising a base having a jewelry mounting location adapted for removably mounting a piece of jewelry; a lid pivotally connected to the base and movable between open and closed positions; and at least one LED disposed on the lid for illuminating the jewelry mounting location when the lid is in the open position.

The present invention further provides An illuminated jewelry case comprising a base having a jewelry mounting location adapted for removably mounting a piece of jewelry; a lid pivotally connected to the base and movable between open and closed positions; a light source disposed on the lid for illuminating the jewelry mounting location when the lid is in the open position; a first battery contact in electrical communication with the light source; a second battery contact; a switch having an open circuit position associated with the closed position of the lid and a closed circuit position associated with the open position of the lid to provide electrical communication between the second battery contact and the light source; and a ribbon cable in electrical communication with the light source, the switch and the battery contacts.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 2:
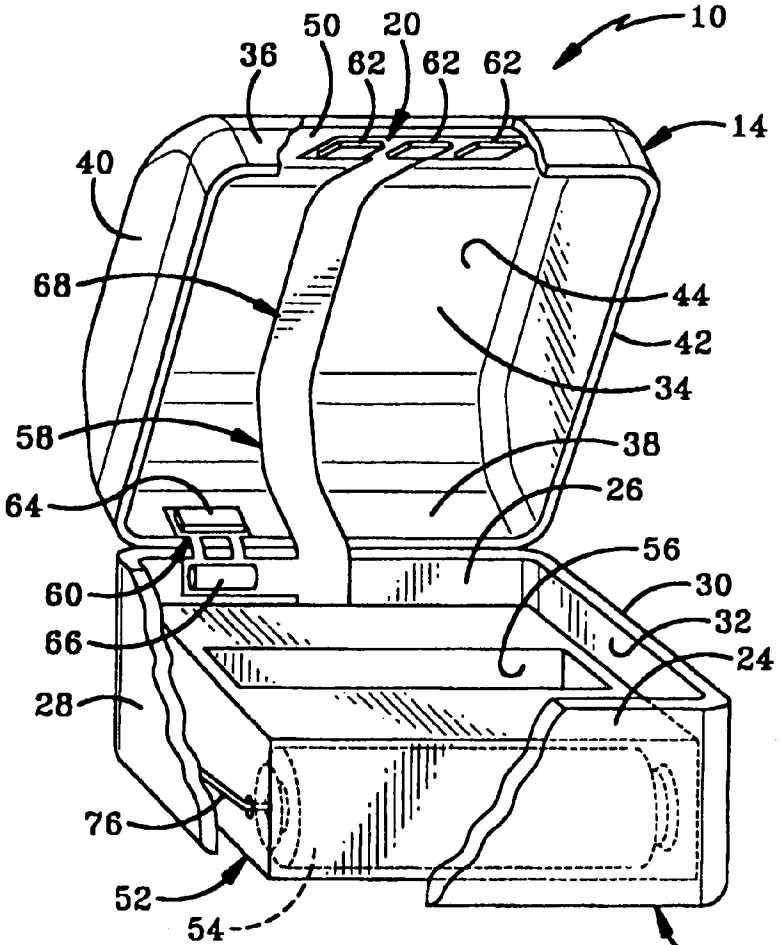
FIG. 2 is a perspective view of the jewelry case with the lining and pillow removed and with portions cut away to show various features of the invention.
Figure 1:
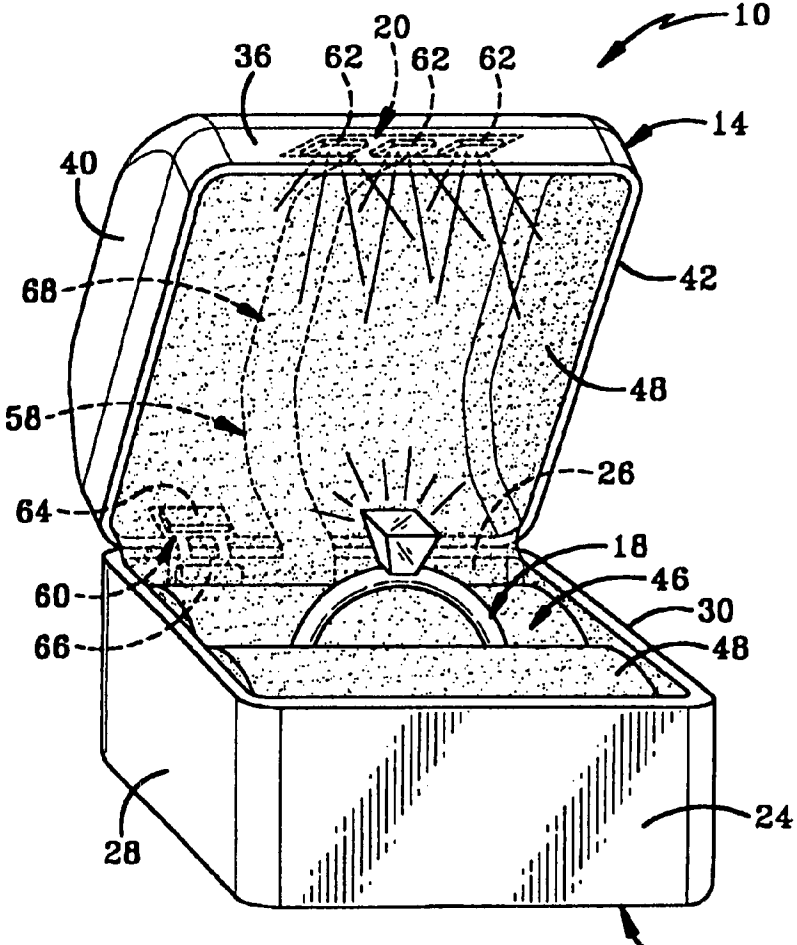
FIG. 1 is a perspective view of the illuminated jewelry case of the present invention.
Figure 6:
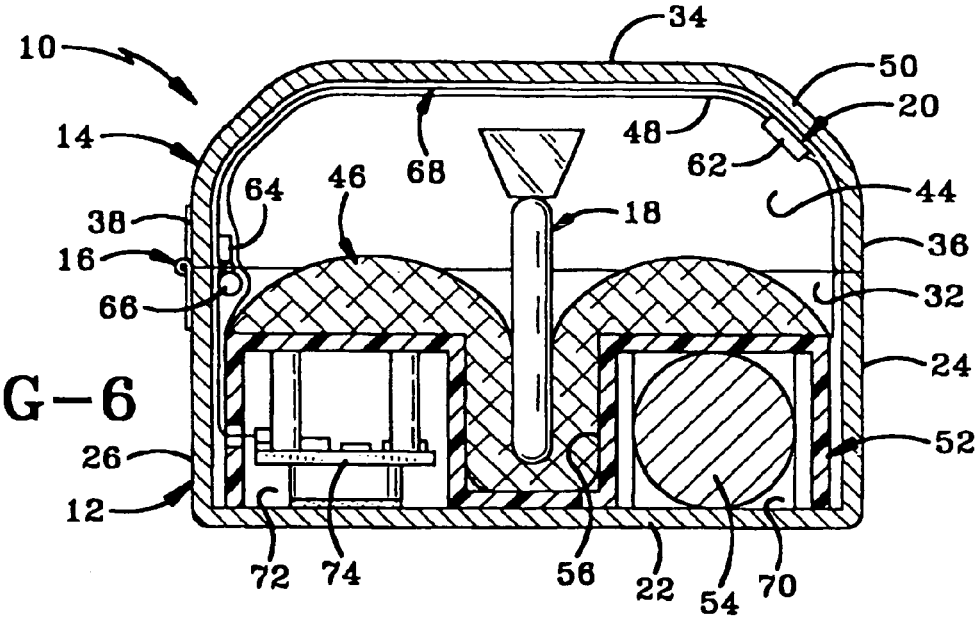
FIG. 6 is a sectional view taken from the side of a jewelry case showing the jewelry case in the closed position with the LEDs turned off.

The illuminated jewelry case of the present invention is indicated generally at 10 in FIGS. 1 and 2. Case 10 includes a base 12 and a lid 14 which are pivotally or hingedly connected to one another via a hinge 16 (FIG. 6). Case 10 is configured to illuminate a piece of jewelry such as a ring 18 with an LED assembly 20 when the case is in an open position, as shown in FIG. 1.

Base 12 includes a bottom wall 22 (FIG. 6), a front wall 24, a rear wall 26, and a pair of side walls 28 and 30. Each of walls 22, 24, 28 and 30 extend upwardly from and are connected to bottom wall 22 to define an interior cavity 32 of base 12. Lid 14 includes a top wall 34, a front wall 36, a rear wall 38 and a pair of side walls 40 and 42. Walls 36, 38, 40 and 42 all extend downwardly from top wall 34 to define an interior cavity 44 of lid 14. Front wall 36 includes an angled section 50 (FIG. 2). A jewelry or ring pillow 46 is disposed in interior cavity 32 of base 12 and is covered by a liner or covering 48 which is typically made of velvet or the like. Covering 48 typically extends from within interior cavity 32 of base 12 into interior cavity 44 of lid 14 to line the inner surfaces of the various walls defining interior cavity 44.

With reference to FIG. 2, case 10 further includes an insert 52 which is disposed within interior cavity 32 of base 12. Insert 52 serves as a housing for a battery 52 and other electronic components as will be detailed further below. Insert 52 defines an upwardly opening central cavity 56 for receiving a portion of ring pillow 46. Battery 54 is part of an electric circuit 58 which is selectively opened and closed by a switch 60 in order to turn three LEDs 62 of assembly 20 on and off when the case is respectively opened and closed. Switch 60 includes a magnet 64 mounted on rear wall 38 of lid 14 and a reed switch 66 mounted on rear wall 26 of base 12 in a position allowing magnet 64 to move away from reed switch 66 when case 10 is open and toward magnet 64 to move closely adjacent reed switch 66 when case 10 is closed. Reed switch 66 is in electrical communication with a ribbon cable 68 which is in part disposed closely adjacent the inner surfaces of rear wall 38, top wall 34 and front wall 36 of lid 14 whereby ribbon cable 68 is in electrical communication with LEDs 62.

Figure 3:
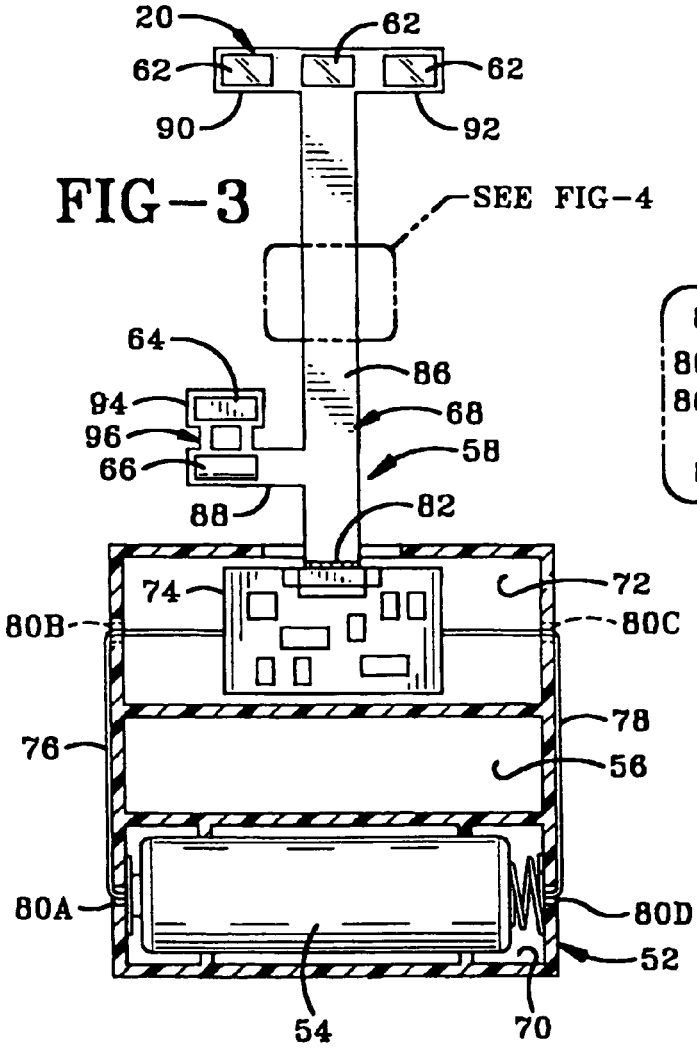
FIG. 3 is a sectional view of the base of the jewelry case showing the electrical configuration of the invention.

With reference to FIG. 3, insert 52 defines a downwardly opening front cavity 70 or battery compartment in which battery 54 is disposed. Insert 52 further defines a downwardly opening rear cavity 72 in which a circuit board 74 is disposed. Battery 54 is in electrical communication with circuit board 74 via wires 76 and 78 which pass through various holes 80A-D into and out of cavities 70 and 72. Circuit board 74 is in electrical communication with ribbon cable 68 at an electrical connection 82 which may include a cable connector or simply be an integral connection.

Figure 4:
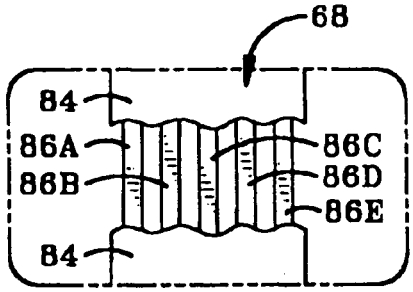
FIG. 4 is an enlarged view of the encircled portion of FIG. 3.

With reference to FIG. 4, ribbon cable 68 includes an insulative sheath 84 which houses a plurality of conductors 86A-E which are typically formed of copper, silver or carbon based trace conductor material. More particularly, sheath 84 is a substantially flat strip of insulative material such as Mylar®/kapton plastic. Referring to FIG. 3, ribbon cable 68 includes an elongated main segment 86, a first arm 88, a second arm 90 and a third arm 92 extending from segment 86. More particularly, first arm 88 extends from main segment 86 to reed switch 66 and is in electrical communication with each of segment 86 and switch 66. Switch 66 is mounted on first arm 88. Second and third arms 90 and 92 extend from main segment 86 distal circuit board 74 and together with segment 86 form a T-shaped configuration.

Preferably, the material forming sheath 84 includes a magnet mounting section 94 on which magnet 64 is mounted and a leaf hinge 96 which extends between and is connected to magnet mounting section 94 and first arm 88. The flexible nature of ribbon cable 68 conveniently allows cable 68 to be positioned closely adjacent the various inner surfaces of base 12 and lid 14 in order to position cable 68 behind covering 48 (FIG. 1). In addition, the material forming sheath 84 may be utilized to form an integral one-piece member which includes segment 86, first, second and third arms 88, 90 and 92, section 94 and leaf hinge 96. This configuration simplifies the assembly of the electrical circuit of case 10.

Figure 5:
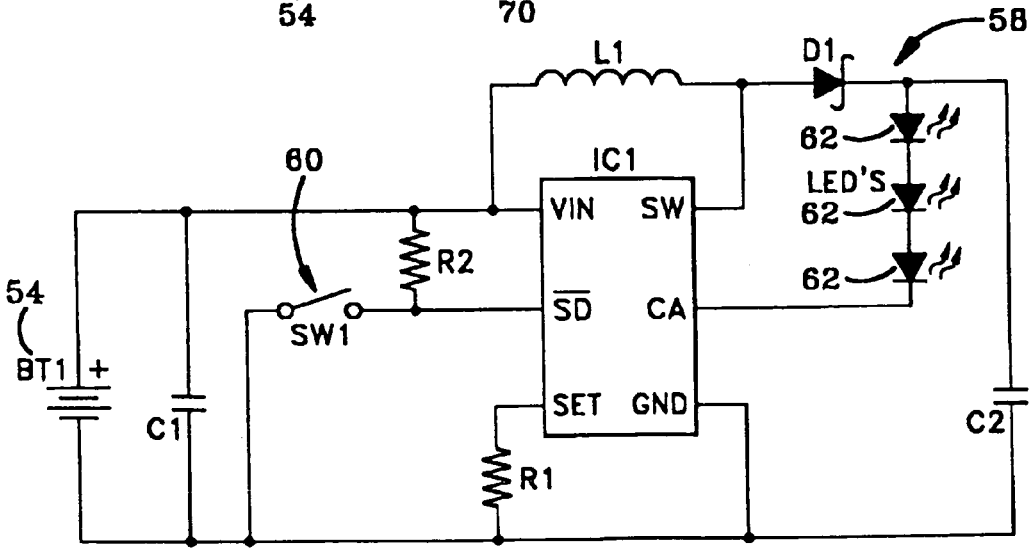
FIG. 5 is an electrical diagram of the electronic assembly of the present invention.

With reference to FIG. 5, an electrical circuit which may be used with the present invention is described. The electrical circuit includes battery 54, first and second capacitors C1 and C2, resistors R1 and R2, switch SW1, inductance L1, rectifier diode D1, LEDs 62 and an integrated circuit IC1 which includes a source voltage VIN, a switch output SW, a shutdown SD, an LED cathode CA, a current programmer SET and a ground GND. Operation of the circuit shown in FIG. 5 will be evident to one skilled in the art, and other electrical circuits may be used.

Figure 7:
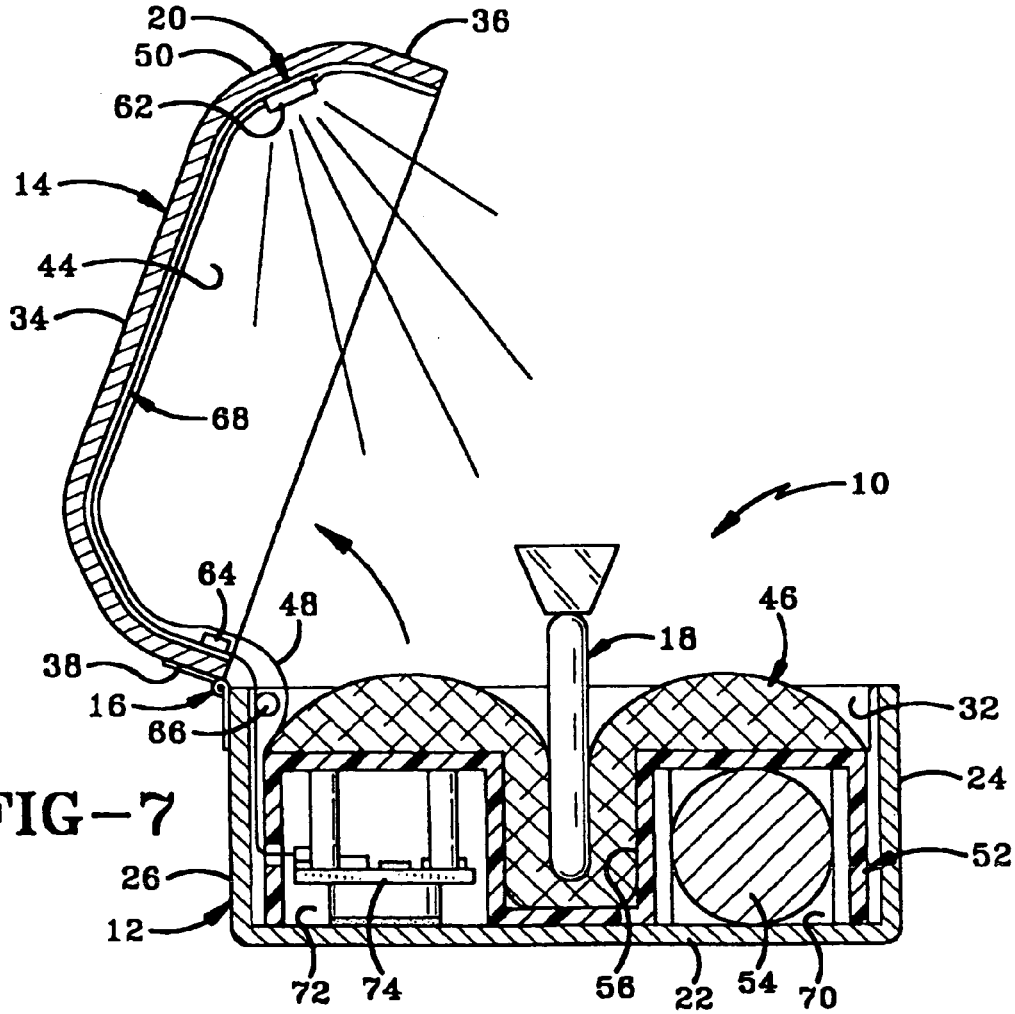
FIG. 7 is similar to FIG. 6 and shows the jewelry case in an open position with the LEDs illuminating the ring disposed in the jewelry case.

FIG. 6 shows case 10 in a closed position with LEDs 62 turned off. This corresponds to magnet 64 being disposed closely adjacent reed switch 66. FIG. 7 shows case 10 in the open position with LEDs 62 illuminating ring 18. More particularly, angled section 50 of lid 14 is configured so that LEDs 62 primarily focus their light on ring 18 when lid 14 is open.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An illuminated jewelry case comprising:

a base having a jewelry mounting location adapted for removably mounting a piece of jewelry;

a lid pivotally connected to the base and movable between open and closed positions;

a light source disposed on an interior of the case for illuminating the case when the lid is in the open position;

a ribbon cable comprising a plurality of electrical conductors in electrical communication with the light source; and an electrically insulative sheath which encases the conductors;

a first section of the sheath mounted on one of the base and lid;

a second section of the sheath mounted on the other of the base and lid; and a portion of the sheath serving as a leaf hinge extending between the first and second sections.

2. The case of claim 1 further comprising:

a first battery contact in electrical communication with the light source;

a second battery contact; and a switch having an open circuit position associated with the closed position of the lid and a closed circuit position associated with the open position of the lid to provide electrical communication between the second battery contact and the light source.

3. The case of claim 2 wherein the ribbon cable is in electrical communication with the switch and the battery contacts.

4. The case of claim 3 wherein the switch is magnetically movable between the open and closed circuit positions.

5. The case of claim 4 further comprising a magnet mounted on one of the base and lid; and a reed switch mounted on the other of the base and lid.

6. The case of claim 5 wherein the portion of the sheath serves as a leaf hinge extending between the magnet and the reed switch.

7. The case of claim 6 wherein the first section of the sheath is a magnet-mounting section to which the magnet is connected and the second section is a switch-mounting section to which the reed switch is connected.

8. The case of claim 7 wherein the ribbon cable comprises a main segment from which one of the two sections extends outwardly.

9. The case of claim 8 wherein the ribbon cable comprises a first arm which extends outwardly from the main segment and is spaced from the two sections; and at least one LED is connected to the first arm.

10. The case of claim 9 wherein the ribbon cable comprises a second arm which extends outwardly from the main segment adjacent the first arm; and at least one additional LED is connected to the second arm.

11. The case of claim 10 wherein the main segment and the two arms together form a T-shaped configuration.

12. The case of claim 2 wherein the switch is magnetically movable between the open circuit position and the closed circuit position.

13. The case of claim 2 wherein the switch comprises a first portion mounted on the base and a second portion mounted on the lid; and the leaf hinge extends between the first and second portions of the switch.

14. The case of claim 13 wherein the first portion of the switch is connected to the first section of the sheath and the second portion of the switch is connected to the second section of the sheath.

15. The case of claim 14 wherein the ribbon cable comprises a main segment from which one of the two sections extends outwardly.

16. The case of claim 13 wherein the ribbon cable is in electrical communication with the switch and the battery contacts.

17. The case of claim 1 further comprising a circuit board in electrical communication with the light source.

18. The case of claim 17 further comprising a first battery contact in electrical communication with the light source; a second battery contact; a cable in electrical communication with the light source and the battery contacts; and wherein the circuit board is in electrical communication with the cable and the battery contacts.

19. The case of claim 18 further comprising a switch having an open circuit position associated with the closed position of the lid and a closed circuit position associated with the open position of the lid to provide electrical communication between the second battery contact and the light source; and wherein the cable is in electrical communication with the switch.

20. The case of claim 17 further comprising a switch in electrical communication with the light source and having an open circuit position associated with the closed position of the lid and a closed circuit position associated with the open position of the lid; and wherein the circuit board is in electrical communication with the switch.

21. An illuminated jewelry case comprising:

a base having a jewelry mounting location adapted for removably mounting a piece of jewelry;

a lid pivotally connected to the base and movable between open and closed positions;

a light source disposed on the lid for illuminating the jewelry mounting location when the lid is in the open position;

a ribbon cable comprising a plurality of electrical conductors in electrical communication with the light source;

wherein the ribbon cable comprises a main segment extending from the base to the lid; and a first arm which extends outwardly from the main segment along the lid; and wherein at least one light source is connected to the first arm.

22. The case of claim 21 wherein the ribbon cable comprises a second arm which extends outwardly from the main segment adjacent the first arm; and wherein at least one additional light source is connected to the second arm.

23. The case of claim 22 wherein the main segment and the two arms together form a T-shaped configuration.

24. The case of claim 21 further comprising a first battery contact in electrical communication with the light source; a second battery contact; a switch having an open circuit position associated with the closed position of the lid and a closed circuit position associated with the open position of the lid to provide electrical communication between the second battery contact and the light source; and wherein the ribbon cable is in electrical communication with the switch and the battery contacts.

25. An illuminated jewelry case comprising:

a base having a jewelry mounting location adapted for removably mounting a piece of jewelry;

a lid pivotally connected to the base and movable between open and closed positions;

a light source disposed on the lid for illuminating the jewelry mounting location when the lid is in the open position;

a first battery contact in electrical communication with the light source;

a second battery contact;

a switch having an open circuit position associated with the closed position of the lid and a closed circuit position associated with the open position of the lid to provide electrical communication between the second battery contact and the light source;

a ribbon cable comprising a plurality of electrical conductors in electrical communication with the light source and the switch;

a main segment of the ribbon cable extending from the base to the lid;

a first arm of the ribbon cable extending outwardly from the main segment; and a first portion of the switch connected to the first arm.

26. The case of claim 25 wherein the first portion is mounted on one of the base and lid; and further comprising a second portion of the switch mounted on the other of the base and lid.

27. The case of claim 26 further comprising an electrically insulative sheath of the ribbon cable encasing the conductors and extending between the first and second portions of the switch.

* * * * *